US006693235B2

(12) United States Patent
Ookubo

(10) Patent No.: US 6,693,235 B2
(45) Date of Patent: Feb. 17, 2004

(54) KEY FOR MUSICAL INSTRUMENT

(75) Inventor: Kenichi Ookubo, Hamamatsu (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 0 days.

(21) Appl. No.: 10/261,603

(22) Filed: Oct. 2, 2002

(65) Prior Publication Data

US 2003/0070534 A1 Apr. 17, 2003

(30) Foreign Application Priority Data

Oct. 16, 2001 (JP) ..... 2001-318581

(51) Int. Cl.[7] ..... G10C 3/12
(52) U.S. Cl. ..... 84/433
(58) Field of Search ..... 84/433, 434, 435, 84/436, 437

(56) References Cited

U.S. PATENT DOCUMENTS 4,119,008 A * 10/1978 Kimble ..... 84/242
4,512,234 A * 4/1985 Kumano ..... 84/433
4,667,563 A * 5/1987 Wakuda et al. ..... 84/439
4,890,533 A * 1/1990 Katsuta et al. ..... 84/439
5,763,799 A * 6/1998 Kimble ..... 84/433
6,191,351 B1 * 2/2001 Niitsuma ..... 84/720

* cited by examiner

*Primary Examiner*—Kimberly Lockett
(74) *Attorney, Agent, or Firm*—Crowell & Moring LLP

(57) ABSTRACT

A key for a musical instrument is provided for effectively giving a touch load to the key, while employing an alternative material having a specific gravity equal to or larger than a predetermined value, instead of lead, as a material for the weight, simplifying works involved in fixing the weight in a key body, and reducing the frequency of troubles such as cracking of the key body, thereby reducing the manufacturing cost. The key comprises a swingable key body formed with an embedding hole which extends through a front plate in the vertical direction to reach the key body, and a weight made of an alternative material other than lead. The weight has a smooth portion and a knurled portion on the outer peripheral surface thereof. The weight is press-fitted into the embedding hole from the smooth portion and thereby fixed in the key body.

2 Claims, 4 Drawing Sheets

KEY FOR MUSICAL INSTRUMENT

BACKGROUND OF THE INVENTION

1. Field of the Invention

The present invention relates generally to a key for use in an upright piano and so on, and more particularly, to a key which has a weight fixed therein to give a required touch load.

2. Description of the Prior Art

Generally, in a keyboard-based musical instrument, particularly, an acoustic piano such as an upright piano, a weight is fixed in a key to provide a desired touch load (static load) for the key. Conventionally, the weight is typically made of lead. As illustrated in FIG. 1, generally, in an upright piano, a weight 32 made of lead of a predetermined size molded into a cylindrical shape is embedded into a embedding hole 33 formed through a key body 52 made of wood of a key 30 at a predetermined position behind a balance pin (not shown), and caulked from both sides for fixation in the key body 31. The lead is employed as the weight in this manner because the lead has a high specific gravity (approximately 11.3) among other metals, is inexpensive, and exhibits high flexibility and ductility which facilitate molding and works as mentioned above.

In the conventional key 30 described above, lead is used as the material for the weight 32 for the reasons mentioned above. However, since lead is an injurious material, it is desirable that an alternative material is used for substitution for lead. Also, the weight 32 is fitted into the embedding hole 33 formed through each key body 31 and fixed by caulking on both sides, and the caulking is required for each key, the works involved in the fixation of the weight 32 are quite laborious. Also, since the weight 32 is fixed by caulking, the key body 31 is highly frequently susceptible to cracking and the like due to an impact applied to the embedding hole when the weight 32 is fixed in the key body 31 by caulking, resulting in an increase in the manufacturing cost.

SUMMARY OF THE INVENTION

The present invention has been made to solve the aforementioned problems, and it is an object of the invention to provide a key which is capable of effectively giving a touch load to the key, simplifying works involved in the fixation of a weight, and reducing the frequency of troubles such as cracking of a key body to reduce the manufacturing cost, while using an alternative material for substitution for lead as a material for the weight.

To achieve the above object, the present invention provides a key for a musical instrument characterized by comprising a swingable key body formed with an embedding hole; and a weight made of an alternative material having a specific gravity equal to or larger than a predetermined value, other than lead, and including a knurled portion on the outer peripheral surface thereof in the longitudinal direction, wherein the knurled portion is press-fitted into the embedding hole to fix the weight in the key body.

In this key, the weight is made of an alternative material having a specific gravity equal to or larger than a predetermined value, other than lead, and has the knurled portion on the outer peripheral surface thereof in the longitudinal direction. Then, the knurled portion is press fitted into the embedding hole formed through the key body to fix the weight in the key body, with the knurled portion applying a pressure to the embedding hole, thereby giving a touch load to the key. Also, since the weight can be fixed in the key body only through press-fitting into the embedding hole, the works involved in fixation is simplified, as compared with a conventional method which fixes a weight in a key body by caulking on both sides.

In addition, since the knurled portion of the weight is limitatively formed in part of the weight in the longitudinal direction, it is possible to limit a pressure to the embedding hole, while ensuring a required holding force of the weight, to reduce the frequency of troubles such as cracking of the key body.

Preferably, in the key set forth above, the key body comprises a front plate in a rear end portion on the top thereof, and a capstan wire implanted on the front plate, and the embedding hole extends through the front plate in the vertical direction to reach the key body.

In this preferred embodiment of the key, the embedding hole is formed through the front plate attached in a rear end portion on the top of the key body, i.e., at the position furthest away from a key fulcrum. It is therefore possible to highly effectively give a touch load to the key when a weight must be fixed in a portion of the key body behind the key fulcrum, as is the case with an upright piano. Generally, the front plate is made of a wood material harder than the key body, and the knurled portion has a large holding force, so that it is possible to reduce the frequency of troubles such as the weight coming off, by press fitting the knurled portion into the front plate, rather than press fitting it into the key body. Further, since the capstan wire is implanted on the front plate for attaching the capstan on the upper end thereof, the implantation of the capstan wire, the formation of the embedding hole, and the fixation of the weight can be efficiently carried out through simultaneous works by installing a machine for implanting the capstan wire and a machine for embedding the weight side by side in the longitudinal direction of the key body, thereby reducing the manufacturing cost.

DETAILED DESCRIPTION OF THE PREFERRED EMBODIMENTS

Figure 1:
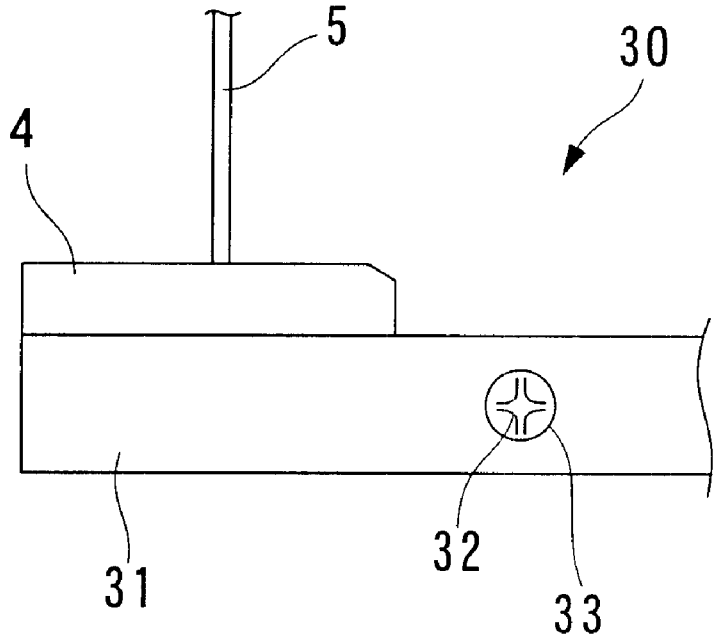
FIG. 1 PRIOR ART
FIG. 1 is a side view illustrating a rear portion of a conventional key for an upright piano.
Figure 2:
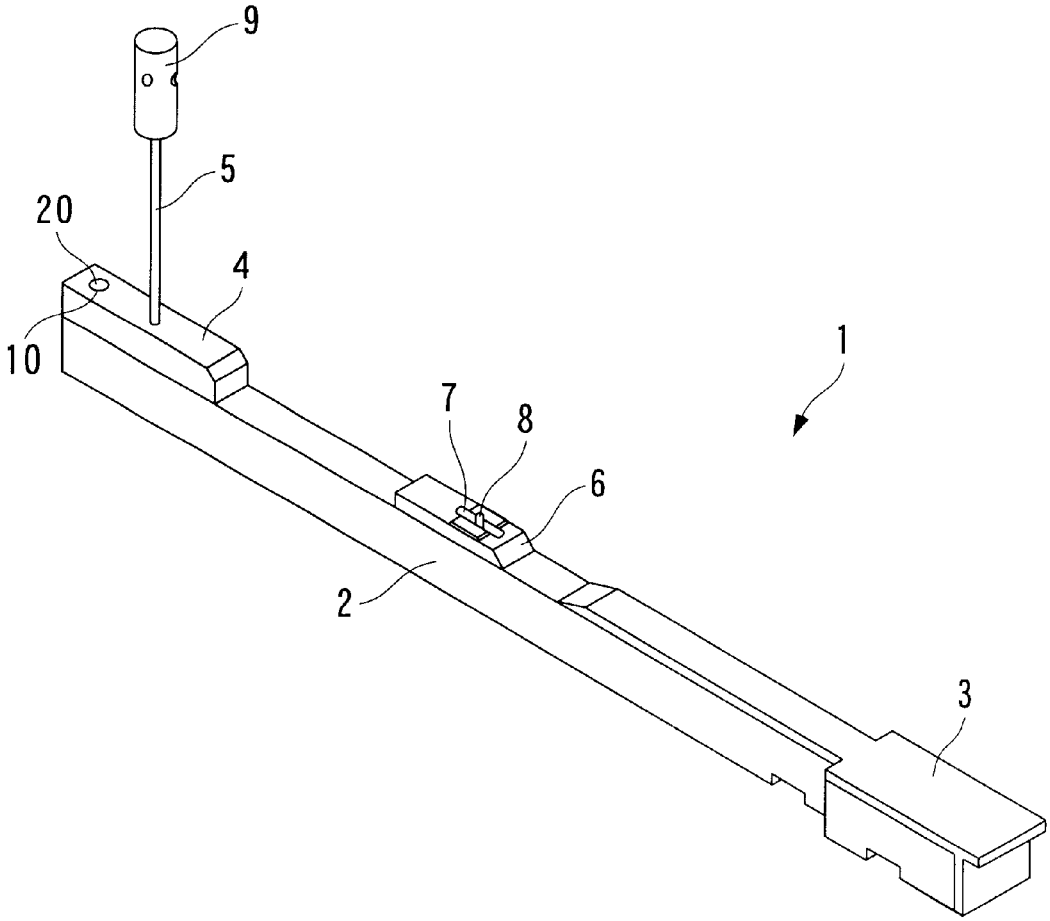
FIG. 2 is a perspective view illustrating a key for an upright piano according to a first embodiment of the present invention.

In the following, several embodiments of the present invention will be described with reference to the accompanying drawings. FIG. 2 illustrates a key (white key) for an upright piano according to a first embodiment of the present invention. As illustrated in FIG. 2, this key 1 comprises a key body 2; and a white key cover 3 attached to a front region of the key body 2. A front plate 4 is attached in a rear portion on the top of the key body 2, and has a capstan wire 5 implanted thereon and a weight 20 embedded therein.

The key body 2 is made of a wood material such as spruce, pine or the like which is relatively light in weight, viscous and highly elastic, and has a rectangular cross section extending in the longitudinal direction. The white key cover 3 is formed of a molding made of a synthetic resin such as acrylic or the like in an L-shape, and is adhered on a front half of the top and a front face of the key body 2 to cover these areas. The front plate 4 is made of a wood material harder than the key body 2, such as beech, maple and the like. An middle plate 6 is adhered in a central portion on the top of the key body 2, and a balance pin hole 7 is formed through them in the vertical direction. This balance pin hole 7 is engaged with the implanted balance pin 8 to swingably support the key 1.

In the structure described above, as a player presses the key 1 on a front portion, the key 1 is swung about the balance pin to push up a capstan 9, causing an action (not shown) to activate. A touch load of the key 1 is determined by the balance of a moment produced by the weight of the action and the key 1 about the balance pin 8.

Figure 3:
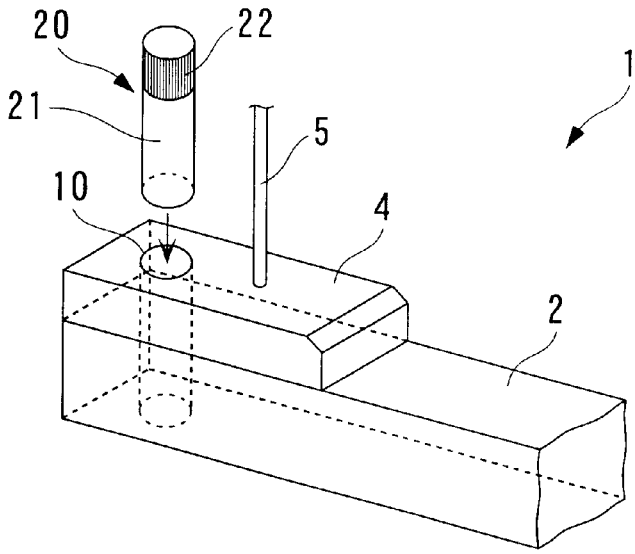
FIG. 3 is a perspective view illustrating a rear portion of the key for an upright piano according to the first embodiment of the present invention.
Figure 4:
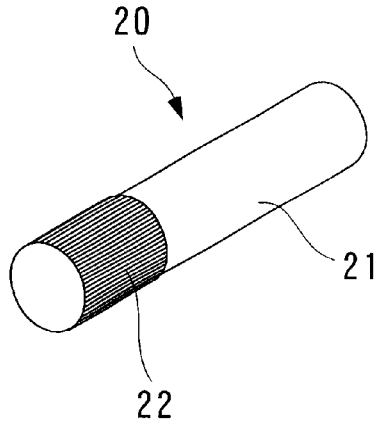
FIG. 4 is a perspective view illustrating a weight.

As illustrated in FIG. 3, an embedding hole 10 is formed in a rearmost portion of the key 1 behind the capstan wire 5. The embedding hole 10 extends through the front plate 4 in the vertical direction to reach the key body 2.

The weight 20 is made of a material other than lead having a specific gravity equal to or larger than a predetermined value, for example, iron or brass, molded in the shape of a cylinder, as illustrated in FIG. 3. The outer peripheral surface of the weight 20 comprises a smooth portion 21, and a knurled portion 22. The knurled portion 22 has an outer diameter slightly larger than that of the smooth portion 21. The weight 20 is inserted into the embedding hole 10 from above, with the smooth portion 21 positioned downward, as illustrated in FIG. 2. Thus, the weight 20 is fixed in the key body 2 with the knurled portion 22 press fitted in the front plate 4. The weight 20 thus embedded gives a touch load to the key 1. In addition, a plurality of weights 20 having different lengths may be provided such that one is selected therefrom for fixation in the key body 2 to readily adjust the touch load given to the key 1.

As described above, according to the key 1 of the first embodiment, the weight 20 is made of an alternative material having a specific gravity equal to or larger than a predetermined value, other than lead, and has the knurled portion 22 in some of the outer peripheral surface in the longitudinal direction. Then, the weight 20 is press fitted, through the knurled portion 22, into the embedding hole 10, so that the weight 20 is fixed in the key body 2 with the knurled portion 22 applying a pressure to the embedding hole 10, thereby giving a touch load to the key 1. Since the weight 20 can be press fitted into the embedding hole 10 for fixation in the key body 2, the works involved in the fixation is simplified as compared with a conventional method of fixing a weight by caulking on both sides. In addition, the embedding hole 10 is formed to extend through the front plate 4 adhered in a rear end portion on the top of the key body 2, i.e., at a position furthest away from the balance pin 8 for fixation of the weight 20 in the key body 2. It is therefore possible to quite effectively give a touch load to the key 1.

Also, since the front plate 4 is made of a wood material harder than the key body 2, the knurled portion 22 has a large holding force, so that the knurled portion 22 of the weight 20 press fitted into the front plate 4 can reduce the frequency of troubles such as the weight 20 coming off the embedding hole 10, and the like, as compared with a weight press fitted into the key body 2. Further, since the capstan wire 5 is implanted on the front plate 4 for attaching the capstan 9 on the upper end thereof, the implantation of the capstan wire 5, the formation of the embedding hole 10, and the fixation of the weight 20 can be efficiently carried out through simultaneous works by installing a machine for implanting the capstan wire 5 and a machine for embedding the weight 20 side by side in the longitudinal direction of the key body 2, thereby reducing the manufacturing cost.

Figure 5:
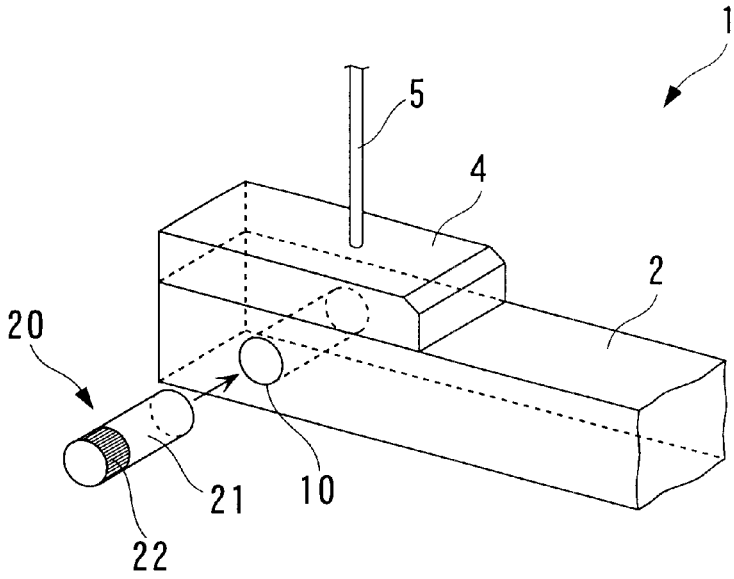
FIG. 5 is a perspective view illustrating a rear portion of a key for an upright piano according to a second embodiment of the present invention.

FIG. 5 illustrates a rear portion of a key 1 for an upright piano according to a second embodiment of the present invention. In the second embodiment, an embedding hole 10 is formed laterally through a key body 2, as is the case with the conventional key 30. Also, like the first embodiment, the outer peripheral surface of a weight 20 comprises a smooth portion 21 and a knurled portion 22. The weight 20 is inserted into the embedding hole 10 of the key body 2 from the smooth portion 21, with the knurled portion 22 press fitted into the key body 2. The remaining structure of the key 1 of the second embodiment is similar to the key 1 of the first embodiment. Accordingly, the key 1 of the second embodiment can reduce the frequency of troubles such as cracking of the key body 2 and the like, and efficiently give a touch load to the key 1, as is the case with the first embodiment.

Figure 6:
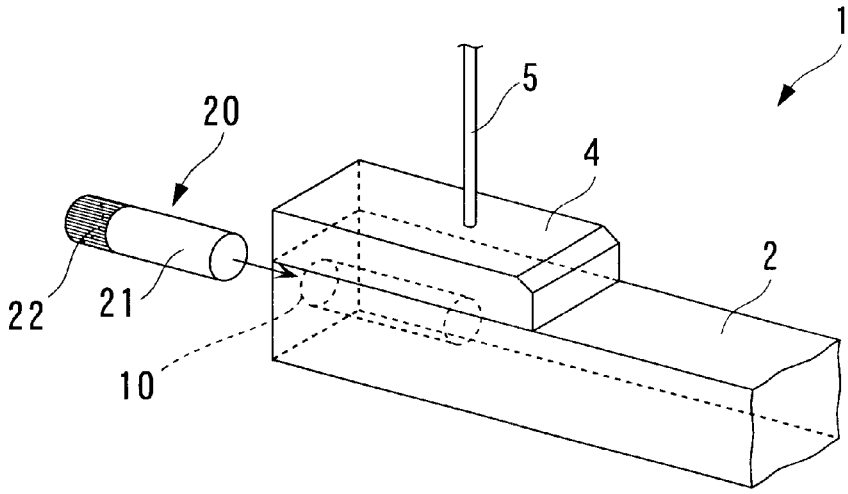
FIG. 6 is a perspective view illustrating a rear portion of a key for an upright piano according to a third embodiment of the present invention.

FIG. 6 illustrates a rear portion of a key 1 for an upright piano according to a third embodiment of the present invention. In the third embodiment, an embedding hole 10 is formed from a far cut end side of a key body 2 in the longitudinal direction of the key body 2. Like the first embodiment, the outer peripheral surface of a weight 20 comprises a smooth portion 21 and a knurled portion 22. The weight 20 is inserted into the embedding hole 10 of the key body 2 from the smooth portion 21, with the knurled portion 22 press fitted into the key body 2. The remaining structure of the key 1 of the third embodiment is similar to the key 1 of the first embodiment. Accordingly, the key 1 of the third embodiment can provide the aforementioned advantages similar to the second embodiment.

While the embodiments illustrated herein are exemplary applications to a key for an upright piano, the present invention can be applied to any key in which a weight is fixed, for example, keys for a grand piano, an electronic piano, a key-board based toy, and the like. Otherwise, the present invention can be modified as appropriate in its details without departing from the spirit and scope of the invention defined by the appended claims.

As described above, the present invention can effectively give a touch load to the key, while employing an alternative material having a specific gravity equal to or larger than a predetermined value, instead of lead, as a material for the weight, simplify works involved in fixing the weight in the key body, and reduce the frequency of troubles such as cracking of the key body, thereby reducing the manufacturing cost.

What is claimed is:

1. A key for a musical instrument comprising:

a swingable key body formed with an embedding hole; and a weight made of an alternative material having a specific gravity equal to or larger than a predetermined value, said weight including a knurled portion on the outer peripheral surface thereof in the longitudinal direction, said knurled portion being press-fitted into said embedding hole to fix said weight in said key body.

2. A key for a musical instrument comprising:

a swingable key body formed with an imbedding hole; and a weight made of an alternative material having a specific gravity equal to or larger than a predetermined value, said weight including a knurled portion on the outer peripheral surface thereof in the longitudinal direction, said knurled portion being press-fitted into said embedding hole to fix said weight in said key body;

wherein said key body comprises a front plate attached in a rear end portion on the top thereof, and a capstan wire implanted on said front plate, and said embedding hole extends through said front plate in the vertical direction to reach said key body.

* * * * *